US006401278B1

(12) United States Patent
Hayes et al.

(10) Patent No.: US 6,401,278 B1
(45) Date of Patent: Jun. 11, 2002

(54) ACCIDENT AND EMERGENCY TROLLEY

(75) Inventors: Stephen Hayes; Stuart Jones, both of West Midlands (GB)

(73) Assignee: Huntleigh Technology, PLC (GB)

( * ) Notice: Subject to any disclaimer, the term of this patent is extended or adjusted under 35 U.S.C. 154(b) by 0 days.

(21) Appl. No.: 09/322,265

(22) Filed: May 28, 1999

Related U.S. Application Data

(63) Continuation of application No. PCT/GB98/02929, filed on Sep. 29, 1998.

(30) Foreign Application Priority Data

Sep. 29, 1997 (GB) ..... 9720563

(51) Int. Cl.[7] ..... A61G 1/02

(52) U.S. Cl. ..... 5/600; 5/86.1; 5/610; 5/613; 296/20

(58) Field of Search ..... 5/600, 601, 607, 5/608, 610, 611, 613, 614, 617, 86.1, 662; 296/20

(56) References Cited

U.S. PATENT DOCUMENTS

| | | | | | |
|---|---|---|---|---|---|
| 3,222,693 | A | * | 12/1965 | Pruim et al. | 5/610 X |
| 3,304,116 | A | * | 2/1967 | Stryker | 5/86.1 X |
| 3,341,246 | A | * | 9/1967 | Lavallee | 296/20 |
| 3,739,406 | A | * | 6/1973 | Koetter | 5/608 |
| 4,164,355 | A | * | 8/1979 | Eaton et al. | 296/20 |
| 4,175,783 | A | * | 11/1979 | Pioth | 296/20 |
| 4,247,091 | A | * | 1/1981 | Glowacki et al. | 5/618 X |
| 4,489,449 | A | * | 12/1984 | Failor et al. | 5/83.1 |
| 4,579,381 | A | * | 4/1986 | Williams | 296/20 |
| 4,584,989 | A | * | 4/1986 | Stith | 5/86.1 X |
| 4,629,242 | A | * | 12/1986 | Schrager | 5/86.1 X |
| 4,723,808 | A | * | 2/1988 | Hines | 5/610 X |
| 4,751,755 | A | * | 6/1988 | Carey, Jr. et al. | 5/614 |
| 4,987,623 | A | * | 1/1991 | Stryker et al. | 5/86.1 |
| 5,083,625 | A | * | 1/1992 | Bleicher | 5/611 |
| 5,187,824 | A | * | 2/1993 | Stryker | 5/600 X |
| 5,377,370 | A | * | 1/1995 | Foster et al. | 5/600 X |
| 5,522,100 | A | * | 6/1996 | Schilling et al. | 5/86.1 |
| 5,636,394 | A | * | 6/1997 | Bartley | 5/611 |
| 5,699,567 | A | * | 12/1997 | Sanders et al. | 5/614 |
| 5,806,111 | A | * | 9/1998 | Heimbrock et al. | 5/600 X |
| 5,987,671 | A | * | 11/1999 | Heimbrock et al. | 5/600 |
| 6,016,580 | A | * | 1/2000 | Heimbrock et al. | 5/610 X |
| 6,076,208 | A | * | 6/2000 | Heimbrook et al. | 5/613 |

FOREIGN PATENT DOCUMENTS

| | | | | |
|---|---|---|---|---|
| GB | 2018221 | * | 10/1979 | 5/610 |
| GB | 2146241 | * | 4/1985 | 5/617 |

OTHER PUBLICATIONS

"626000 Uni–Care® II Specifications", 1982.*

International Search Report for International Application No. PCT/GB 98/02929, date mailed Feb. 2, 1999.

* cited by examiner

*Primary Examiner*—Lynne H. Browne
*Assistant Examiner*—Robert G. Santos
(74) *Attorney, Agent, or Firm*—Brown Raysman Millstein Felder & Steiner LLP

(57) ABSTRACT

An accident and emergency trolley supports and transports a patient, and includes a surface overlying an upper frame which is supported on a base frame in order to be raised and lowered relative to the base frame. The upper frame is mounted at its periphery on opposed radius arms connected to respective first and second actuators, which are operated by foot-operated pedals. The pedals are disposed on one or either side of the trolley such that operation of any single pedal enables the trolley to be raised at either end or both ends simultaneously. The opposed radius arms provide an uninterrupted window under the trolley allowing for X-ray/imaging.

19 Claims, 3 Drawing Sheets

ACCIDENT AND EMERGENCY TROLLEY

This application is a continuation of PCT/GB98/02929 filed Sep. 29, 1998.

BACKGROUND OF THE INVENTION

1. Field of the Invention

This invention relates to a trolley in particular to an accident and emergency trolley.

2. Description of Related Art

It is known to provide accident and emergency trolleys designed to be raised and lowered, tilted longitudinally, but such conventional trolleys suffer from the disadvantages of being difficult to operate and manouver and the patient having to be transferred to another surface for X-rays or imaging.

SUMMARY OF THE INVENTION

Accordingly, the present invention provides an accident and emergency trolley for supporting and transporting a patient comprising a surface overlying an upper frame, the upper frame supported on a base frame so that it can be raised and lowered relative to the base frame, the upper frame being mounted at its periphery on opposed radius arms connected to respective first and second actuators, the actuators operated by foot operated pedals, said pedals is disposed on one or either side of the trolley such that operation of any single pedal enables the trolley to be raised at either end or both ends simultaneously. Advantageously, the opposed radius arms provide an uninterrupted window under the trolley allowing for X-ray/imaging. Further their operation is much simplified only requiring a single operation compared to the complex arrangement of pedals on conventional trolleys in order to achieve tilt. Preferably, the pedals for all functions are advantageously located at each side of the trolley allowing for easy access and avoids the operators having to travel and operate pedals located around the trolley for individual functions.

Preferably, the pedals may only be operated with a downward force, thereby providing easier operation. Previous trolleys have pedals which need to be pushed up to operate actuators for certain tilt functions.

Preferably, the trolley comprises a castor mounted centrally on the base frame by resilient means and arranged to engage in either of two positions 180° apart so as to provide directional tracking in line with longitudinal axis of the trolley. Therefore, if pushed in a longitudinal direction the castor automatically latches and provides improved steering and maneuverability.

Advantageously, the trolley surface may be sectional to provide at least a backrest movable from a rest position to an inclined position, by means of actuators operable by a single push action, for ease of operation.

Preferably, the trolley additionally comprises safety side rail assemblies each comprising rail arms pivotally mounted on a support member suspended from the upper frame by links, the rail arms movable from a horizontal stowed position to a vertical in-use position, the support member being linked to the upper frame such that it is stowable under its own weight, the arms being locked in their in-use position.

The side rail assemblies advantageously provide for safety of the patient but can be stowed away under the upper frame so that there is no transfer gap when transferring a patient from the trolley to an operating table, bed or similar.

BRIEF INVENTION OF THE DRAWINGS

A preferred embodiment of the present invention will now be described in detail, by way of example only, with reference to the accompanying drawings in which.

DETAILED DESCRIPTION OF THE PREFERRED EMBODIMENTS

Figure 1:
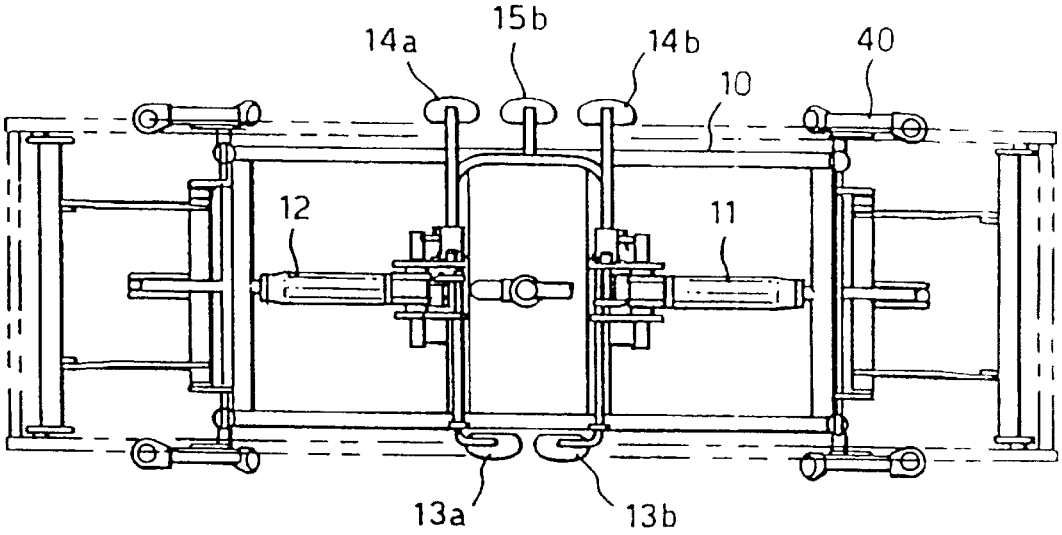
FIG. 1 is a plan view the trolley frame showing the pedal arrangement.
Figure 2:
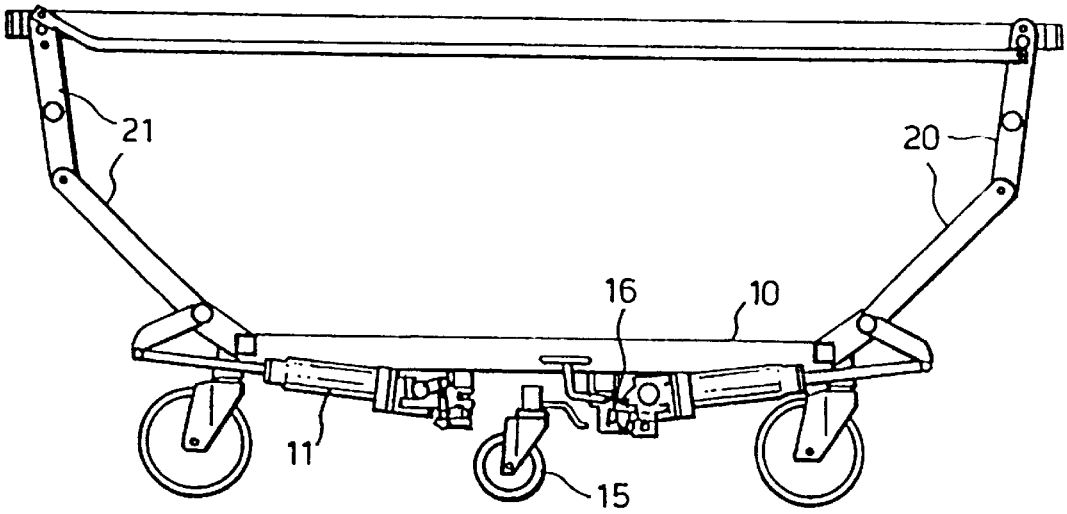
FIG. 2 is a side view of the same frame in FIG. 1; showing the opposing radius arms.

Referring to the drawings, the trolley consists of a fabricated steel base frame 10 to which are mounted two opposing hydraulic pump/cylinder assemblies 11,12 and five castors. Each pump 11,12 can be individually operated by means of its own independent pedal 13*a*,13*b* or 14*a*,14*b*, which extends cylinder length and alternatively both pumps can be operated simultaneously via a common central pedal 15*b*(15*a* not shown for clarity).

The pumps are pivoted at their rear end and connected to a radius arm mechanism at the other. Each pump 11,12 is connected to the respective pedal 13*b*,14*b* or 13*a*,14*a* by a lever and connecting rod with spherical rod ends allowing for radial movement. Alternatively, both pumps can be operated simultaneously using a single pedal 15*b* that depresses the two independent pedals 13*b*,14*b* (the arrangement of pedal 15*a* not shown)

Both pumps 11,12 have release mechanisms at the rear end, which can be operated independently or simultaneously to reduce cylinder length. The release mechanism incorporates a cam 16 which ensures that the release pedal remains in a constant position, regardless of inclined angle of the hydraulic pump. Both pumps are fitted with flow control devices (not shown) which govern the rate of descent and maintain relative position end to end, independent of load.

Both sets of operating pedals 13*a*,14*a*,15*a* or 13*b*,14*b*,15*b* may be fitted to either side of the trolley, to allow easy access and use from either side.

This configuration allows either end of the trolley to be raised or lowered either independently or simultaneously. This facilitates instantaneous longitudinal tilt in either direction at any height, with just one pedal action.

As shown in FIG. 1, the opposing radius arms 20,21 give four point support of the trolley surface, the radius arm assemblies are connected to the four corners of the trolley surface providing widely spread attachment points for stability along with full access over the entire length of the trolley for imaging and X-ray purposes.

The trolley surface can be built as either a two or four section version. A backrest 18 is pivoted at its bottom end and supported at its top end by a lockable gas spring. Two release buttons 60 are connected via a linkage mechanism such that depression of either button 60 unlocks the gas springs and thereby assists in the raising of the backrest. On the four section variant, the calf section may be elevated using a hand wound screw assembly.

Another benefit of this configuration is that a very low minimum height is achievable between the floor and the mattress platform.

Figure 5:
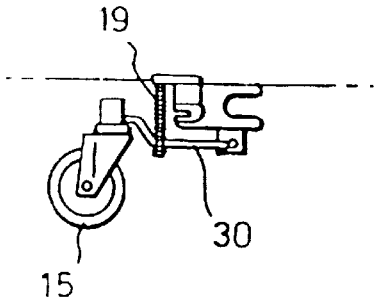
FIG. 5 is a schematic drawing of the centre castor arrangement.
Figure 6:
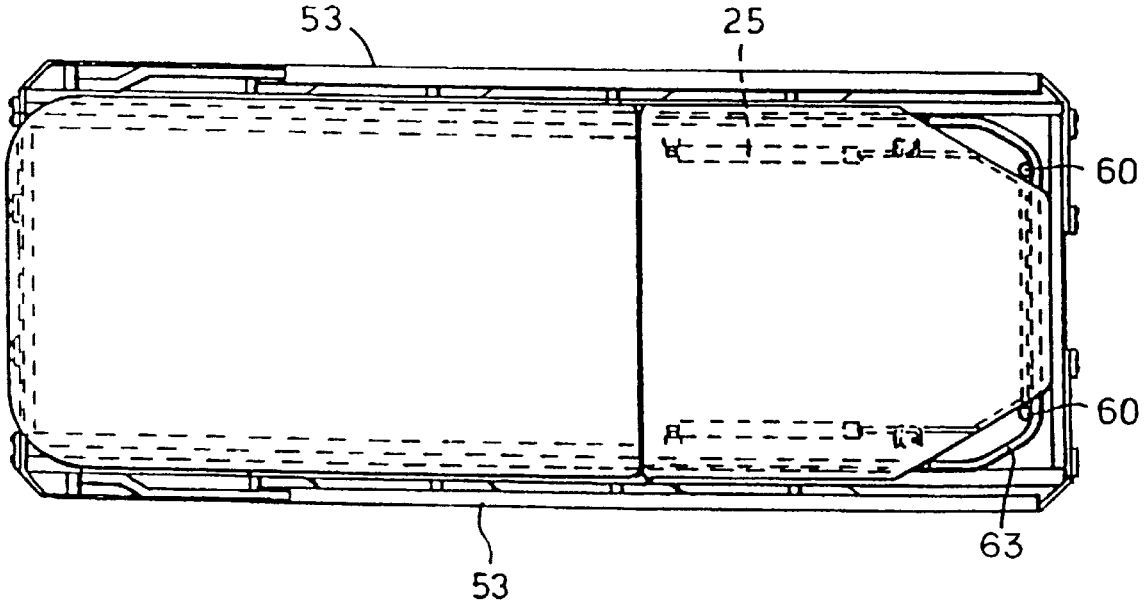
FIG. 6 is a plan view of the surface of the trolley including a backrest according to the invention.

As shown in FIG. 5, a fifth castor 15 is fitted centrally on the base frame 10, mounted on a spring 19 loaded and pivoted trailing arm 30 which allows for undulations in the floor surface. The castor 15 incorporates a spring-loaded latch (not shown) which automatically engages in either of two positions 180° apart, to give directional lock, with these positions being set in line with the longitudinal axis of the trolley. If being pushed in a longitudinal direction the castor 15 automatically latches to give tracking and if pushed in a transverse direction the latch automatically disengages. The central positioning facilitates a turning point for a much smaller turning circle for the trolley.

The trolley also has four brake rocker-type pedals 40, one at each corner, which are inter-connected in such a way that any of the four pedals 40 will apply braking if operated downward on one side. Similarly, the braking can be released by operation of any of the four pedals, by applying downward thrust to the other side of the pedal.

Figure 3:
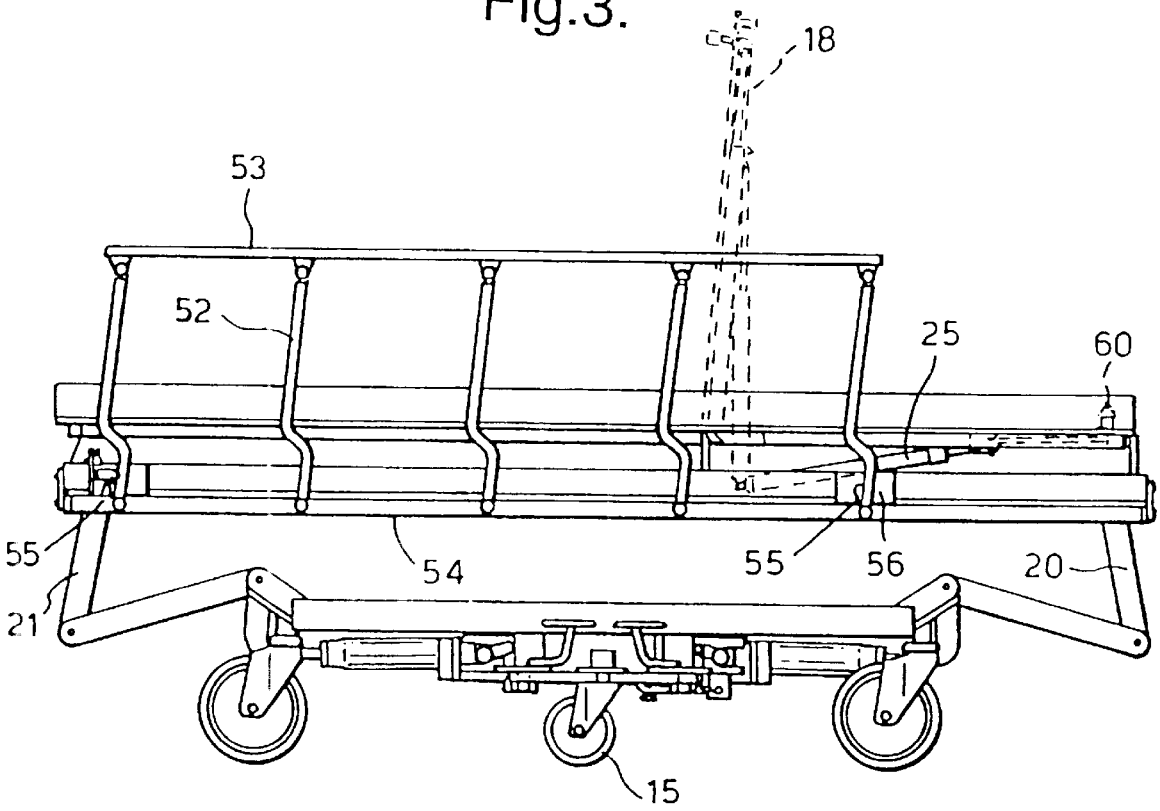
FIG. 3 is a side view of the trolley frame showing the trolley lowered and side rails extended.
Figure 4:
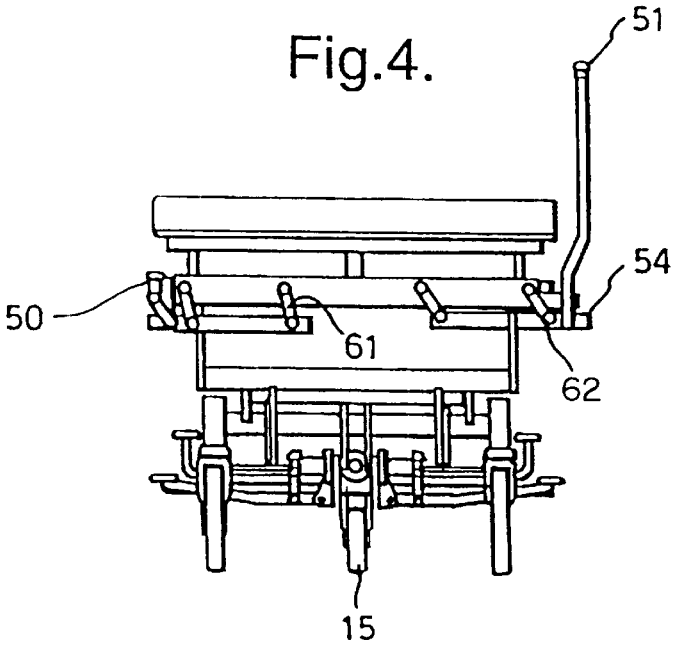
FIG. 4 is an end view of the trolley showing one side rail extended and other side rail stowed.

The safety side rail assemblies (50,51) as shown in FIG. 3, 4 consist of a series of pivoting upright arms 52 connected by upper 53 and lower 54 rails. The lower rail assembly 54 is suspended from the upper frame of the trolley by four link arms (only two shown at one end) 61,62 (FIG. 4), forming a pantograph mechanism. This allows the safety side rail assemblies (50,51) to be partially stowed under the trolley surface when not required and is designed such that it stows automatically under its own weight. When required each safety side rail assembly may be pulled out from its stowed position and raised by holding the upper rail. As each safety side rail assembly is raised, catch plates 55 at either end of the assembly ride over striker plates 56 until they engage. The safety side rail assembly is thereby locked in its raised and extended position via engagement of the latch and contact between catch plates and striker plates.

In order to ensure that the safety side rail assemblies operate smoothly, even when operated from one end, the link arms 61,62 are connected end to end via a full length shaft.

The bottom side rail assembly incorporates a bumper strip along its entire length, to offer some protection against damage via light collisions.

The stowage of the safety side rail assemblies 50,51 under the trolley surface results in a minimum transfer gap when loading or unloading the patient.

When the safety side rail assemblies are upright, a clear working area is generated at the head end of the trolley for ease of treatment.

The backrest assembly 18 incorporates a gas spring 25 arrangement which assists the carer when lifting the backrest with the patient in position by depressing the release knob (60) and the grip handle (63) the backrest can be raised or lowered to the required position. The backrest may be inclined by means of a pivot at the bottom end of the backrest, or may incorporate a linear sliding bush arrangement allowing for retraction of the bottom end of the backrest when raised.

What is claimed is:

1. An accident and emergency trolley for supporting and transporting a patient, wherein the trolley has two sides and two ends, the sides being longer than the ends, the trolley comprising:

a surface overlying an upper frame, the upper fame supported on a base frame so that the upper frame can be raised and lowered relative to the base frame, the upper frame being mounted at its periphery on opposed radius arms connected to respective first and second actuators, the actuators operated by foot operated pedals, the pedals disposed on at least one side of the trolley such that operation of a single pedal enables the upper frame to be raised or lowered at either end or both ends simultaneously regardless of an initial raised or lowered position of either end or both ends of the upper frame.

2. An accident and emergency trolley as claimed in claim 1, wherein the pedals are located at both sides of the trolley.

3. An accident and emergency trolley as claimed in claim 1, further comprising a castor mounted centrally on the base frame by resilient means and arranged to engage the floor in either of two positions 180° apart so as to provide directional tracking in line with the longitudinal axis of the trolley.

4. An accident and emergency trolley as claimed in claim 1, wherein the trolley surface is sectional providing at least a backrest movable from a rest position to an inclined position, by means of actuators operable by a single push action, for ease of operation.

5. An accident and emergency trolley as claimed in claim 1, further comprising safety side rail assemblies each comprising rail arms pivotally mounted on a support member suspended from the upper frame by links, the rail arms movable from a horizontal stowed position to a vertical in-use position, the support member being linked to the upper frame such that it is stowable under its own weight, the arms being locked in their in-use position.

6. An accident and emergency trolley as claimed in claim 1, wherein the pedals are operated with a downward force.

7. A trolley for supporting and transporting a patient, wherein the trolley has two sides and two ends, the sides being longer than the ends, the trolley comprising:

a base frame;

an upper frame having opposed radius arms;

a surface overlying the upper frame; and an actuator;

wherein the upper frame is supported on the base frame so that the upper frame can be raised and lowered relative to the base frame;

wherein the upper frame is mounted at its periphery on the opposed radius arms and connected to the actuator; and wherein the actuator is operated by a foot-operated pedal disposed on at least one side of the trolley such that operation of the pedal enables the upper frame to be raised at either end or both ends simultaneously regardless of an initial raised or lowered position of either end or both ends of the upper frame.

8. The trolley of claim 7, further comprising a plurality of pedals.

9. The trolley of claim 8, wherein the plurality of pedals are used for a plurality of respective functions.

10. The trolley of claim 8, wherein the plurality of pedals are distributed to be positioned at both sides of the trolley.

11. The trolley of claim 7, further comprising:

resilient means; and a castor mounted centrally on the base frame by the resilient means, with the castor configured to engage the floor in either of two positions.

12. The trolley of claim 11, wherein the two positions of castor are 180° apart so as to provide directional tracking in line with the longitudinal axis of the trolley.

13. The trolley of claim 7, wherein surface is sectional and includes a backrest.

14. The trolley of claim 13, wherein the backrest, responsive to a single push action of a backrest actuator, is movable from a rest position to an inclined position.

15. The trolley of claim 7, further comprising:

safety side-rail assemblies, each assembly having rail arms pivotally mounted on a support member suspended from the upper frame by links, with the rail arms movable from a horizontal stowed position to a vertical in-use position, the support member being linked to the upper frame such that the support member is stowable under its own weight with the arms being locked in an in-use position.

16. The trolley of claim 7, wherein the actuator is operated by a second foot-operated pedal disposed on at least one side of the trolley such that operation of the second pedal enables the trolley to be lowered at either end or both ends simultaneously regardless of the initial position of either end or both ends of the trolley.

17. The trolley of claim 16, wherein the second pedal is operated with a downward force.

18. A trolley for supporting and transporting a patient, the trolley comprising:

a base frame;

an upper frame having opposed radius arms;

a surface overlying the upper frame, wherein the surface is sectional and includes a backrest; and a plurality of actuators, including a backrest actuator;

wherein the upper frame is supported on the base frame so that the upper frame can be raised and lowered relative to the base frame;

wherein the upper frame is mounted at its periphery on the opposed radius arms and connected to a predetermined set of the plurality of actuators; and wherein at least one of the plurality of actuators is operated by a foot-operated pedal disposed on at least one side of the trolley such that operation of the pedal enables the upper frame to be raised at either end or both ends simultaneously regardless of an initial raised or lowered position of either end or both ends of the upper frame; and wherein the backrest, responsive to actuation of the backrest actuator, is movable from a rest position to an inclined position.

19. The trolley of claim 18, further comprising:

safety side-rail assemblies, each assembly having rail arms pivotally mounted on a support member suspended from the upper frame by links, with the rail arms movable from a horizontal stowed position to a vertical in-use position.

* * * * *

UNITED STATES PATENT AND TRADEMARK OFFICE

CERTIFICATE OF CORRECTION

PATENT NO. : 6,401,278 B1
DATED : June 11, 2002
INVENTOR(S) : Hayes et al.

It is certified that error appears in the above-identified patent and that said Letters Patent is hereby corrected as shown below:

Column 1,
Line 27, remove "is"

Signed and Sealed this

Nineteenth Day of November, 2002

*Attest:*

*Attesting Officer*

JAMES E. ROGAN
*Director of the United States Patent and Trademark Office*